United States Patent [19]

Nakanishi et al.

[11] 4,402,739

[45] Sep. 6, 1983

[54] METHOD OF OPERATION OF A TOP-AND-BOTTOM BLOWN CONVERTER

[75] Inventors: Kyoji Nakanishi, Chiba; Kenichiro Suzuki, Kurashiki; Michio Tanaka, Kurashiki; Jun-ichi Matsuno, Kurashiki; Hisashi Ohmori, Kurashiki; Tsutomu Nozaki, Chiba, all of Japan

[73] Assignee: Kawasaki Steel Corporation, Hyogo, Japan

[21] Appl. No.: 397,859

[22] Filed: Jul. 13, 1982

[51] Int. Cl.[3] ..... C21C 5/32; C21C 5/34

[52] U.S. Cl. ..... 75/60; 75/59; 266/47

[58] Field of Search ..... 75/51, 52, 59, 60; 266/47

[56] References Cited

U.S. PATENT DOCUMENTS

| | | | |
|---|---|---|---|
| 3,661,560 | 5/1972 | Grenfell | 75/60 |
| 4,178,173 | 12/1979 | Gorges | 75/60 |
| 4,190,238 | 2/1980 | Schoop | 75/60 |
| 4,195,985 | 4/1980 | Brotzmann | 75/60 |
| 4,290,802 | 9/1981 | Hirata | 75/59 |

*Primary Examiner*—P. D. Rosenberg

*Attorney, Agent, or Firm*—Wenderoth, Lind & Ponack

[57] ABSTRACT

In the operation of a top-and-bottom blown converter, top-blowing oxygen gas is blown such that the center of a hot spot created by the oxygen gas jet from each of the nozzles of a top-blowing multi-nozzle lance is positioned outside a bubbling region of the molten metal surface which rising bubbles of gas from bottom-blowing tuyeres reach.

5 Claims, 10 Drawing Figures

METHOD OF OPERATION OF A TOP-AND-BOTTOM BLOWN CONVERTER

BACKGROUND OF THE INVENTION

This invention relates to a method for operating a top-and-bottom blown converter.

As is well known in the art, conventional top-blown converters which are also referred to as LD converters often experience operating difficulties due to the phenomenon that molten metal is ejected out of the converter, which is generally called slopping and which is attributable to excessive oxidation of molten metal by the top blowing oxygen gas. To eliminate such a problem, top-and-bottom blown converters were recently developed by taking advantage of the oxygen bottom blown converter and have been commercially used in iron works. The top-and-bottom blown converters are generally constructed by modifying existing top-blown converters. More specifically, referring to FIG. 10, the top-blown converter is modified by providing a plurality of bottom blowing tuyeres 2 extending through a converter bottom 1 which is removably secured to a converter housing 7. A top-blowing lance 3 is vertically inserted through a top opening of the converter. With this arrangement, jets 4 of oxygen gas are blown through the top-blowing lance 3 onto the surface of a molten metal bath 6 while an agitating gas 5 such as oxygen gas or argon gas is blown into the molten metal bath 6 through the tuyeres 2. This type of top-and-bottom blown converter is free of slopping since the molten metal is vigorously agitated by the bottom blowing gas to prevent the molten metal from being excessively oxidized with the top-blowing gas. Since a top-and-bottom blown converter constructed by modifying an LD converter, however, has a housing of a specific profile designed for the LD converter operation requiring top blowing only, the bottom blowing gas causes the molten metal to wave or vibrate and eventually the converter housing to severely vibrate, resulting in a variety of troublesome problems.

The problems involved in the conventional top-and-bottom blown converters will be described in more detail. Since the molten metal and hence the converter housing vibrate to a lesser extend in a normal top-blown converter operation than in an oxygen bottom-blown converter operation, a support for the housing of the top-blown converter is generally of a lesser strength as compared with that for the oxygen bottom-blown converter. On the other hand, the molten metal bath is vibrated to a large extent with the bottom blowing gas in the top-and-bottom blown converter. If a top-and-bottom blown converter is a modification of a top-blown converter having a housing support of a relatively low strength, the vibration of molten metal is transmitted to the converter housing so that the converter housing is severely vibrated. This vibration leads to several drawbacks, i.e. that the housing support is susceptible to fatigue failure and that the operation of the converter becomes unstable and, in some cases, the vibration is detrimental to the safety of the operators.

In order to minimize the above-mentioned vibration caused by the blowing of bottom-blowing gas, it is believed effective to locate bottom-blowing tuyeres remote from the center of the converter bottom and spaced apart from each other. However, in a top-and-bottom blown converter which is constructed by modifying a top-blown converter, it is difficult to distribute the bottom-blowing tuyeres in a spaced-apart relationship because of the housing profile and other factors. It is known that the life of tuyeres is considerably shortened if the tuyeres are washed with molten metal, that is, alternately exposed to air and molten metal during charging and tapping of molten metal. The oxygen bottom-blown converter has a housing profile approximating a spherical shape, that is, a housing profile having a reduced ratio H/D of housing height H to the maximum D of housing inner diameter, such that the bulge of a converter barrel serves as a reservoir for molten metal when the converter housing is tilted for charging or tapping of molten metal. Then the bottom blowing tuyeres are prevented from being washed upon charging or tapping even when they are spaced apart from each other and from the axis of the converter. However, a top-and-bottom blown converter which is constructed by modifying a conventional top-blown converter has the housing profile of the top-blown converter, that is, a vertically elongated profile approximating a rotary oval body having a less bulged barrel and an increased height-to-diameter ratio H/D. It thus is not possible to tilt the modified converter over a large angle for charging or tapping of molten metal. Since the lower portion of the converter barrel and the peripheral portion of the converter bottom constitute a metal reservoir upon loading and tapping of molten metal, the bottom blowing tuyeres should be collectively arranged on or in proximity of a line passing through the axis of the converter and parallel to the trunnion axis to prevent the bottom-blowing tuyeres from being washed with the molten metal upon charging or tapping thereof. The location of bottom blowing tuyeres is limited in a top-and-bottom blown converter which is constructed by modifying a top-blown converter, and it is very difficult in practice to reduce the vibration of a molten metal bath by arranging the bottom-blowing tuyeres in a spaced-apart relationship.

A primary object of the present invention is to minimize vibration of a molten metal bath in a top-and-bottom blown converter to thereby diminish vibration of the converter housing.

Taking into account the advantage of the top-and-bottom blown converter that the location of hot spots created by oxygen gas from a top-blowing lance need not be limited to the proximity of the axis of the converter because agitation of a molten metal bath is improved over the top-blown converter, and more specifically, the molten metal is agitated with the bottom-blowing gas to such a full extent that the top-blowing oxygen gas need not assist in agitating the molten metal, we determined the relationship of the location of hot spots to the vibration of molten metal by changing the top-blowing lance to vary the location of hot spots associated therewith. Finding that the magnitude of vibration of molten metal is closely related to the relative location of the hot spots and the bottom-blowing gas bubbling region, and more specifically, the vibration of molten metal can be minimized by designing the top-blowing multi-nozzle lance such that a hot spot created by a jet of oxygen gas from each of the nozzles of the lance is located outside the bottom-blowing gas bubbling region, we have achieved the present invention.

In conventional top-blown converters, it is a common practice to blow oxygen gas onto the surface of molten metal through a top-blowing lance thereabove for the purpose of effecting desiliconization, decarbonization and dephosphorization. The top-blowing lance usually has a plurality of, for example, three or four nozzles. A typical top-blowing lance is shown in FIG. 1 as having four nozzles 8 whose axis is at a small angle of about 8°–10° with respect to the axis of the lance 3. The angle of the nozzle axis with respect to the lance axis is referred to as nozzle inclination angle, hereinafter. A nozzle inclination angle on the order of 8°–10° is generally used in a multi-nozzle lance for conventional top-blown converters for the following reason. To increase the efficiency of decarbonization, it is required that the nozzle inclination angle be reduced to concentrate the associated oxygen jets within a relatively narrow region on the molten metal surface to allow the oxygen jets to impinge against the molten metal without dispersing their kinetic energy to reduce the kinetic energy per unit area. The concentrated energy causes the molten metal to be vigorously agitated. On the other hand, to promote slagging and dephosphorization, the nozzle inclination angle is desirably increased to cause part of the oxygen to be absorbed in a slag layer on the molten metal surface over a relatively large area. As a compromise between these contradictory requirements, the nozzle inclination angle is determined as described above. Furthermore, in conventional top-blown converters, the top-blowing lance is aligned with the axis of the converter for the purpose of rendering the molten metal reaction uniform and because of its location relative to the converter opening. The high temperature zones which are created on the molten metal surface by oxygen gas jets injected thereon through the top-blowing lance, that is the so-called hot spots, are located within a relatively narrow region which is confined around the axis of the converter on the basis of the nozzle inclination angle.

Nevertheless, the top-and-bottom blown converters constructed by modifying top-blown converters actually use the same lance as used in the top-blown converters although metallurgical effect, particularly molten metal agitating effect, is apparently different therebetween. As a result, the hot spots created by the top blowing gas from the lance are generally located within a relatively narrow region extending about the axis of the converter as in the case of the top-blown converters. On the other hand, the bottom-blowing tuyeres in the modified type of top-and-bottom blown converter must be collectively arranged on or in proximity of a line passing through the converter axis and parallel to the trunnion axis for the reason of tuyere life as described earlier. Consequently, the hot spots P created by the top-blowing gas from the lance 3 are located within a bubbling region of the molten metal surface which rising bubbles of the bottom-blowing gas from the tuyeres 2 reach (bottom-blowing gas bubbling region) or the hot spots P largely overlap the bottom-blowing gas bubbling region as seen from FIG. 10. When a conventional top-blowing lance was used in the top-and-bottom blown converter, it was difficult to locate the hot spots created by the gas from the top-blowing lance outside the bottom-blowing gas bubbling region.

SUMMARY OF THE INVENTION

The present invention relates to the operation of a top-and-bottom blown converter including tuyeres arranged at the bottom for blowing a gas into a molten metal bath in the converter and a multi-nozzle lance inserted through a top opening of the converter for blowing jets of oxygen gas onto the bath surface. According to the method of the present invention, the top-blowing oxygen gas is blown such that the center of a hot spot created by the oxygen gas jet from each of the nozzles of the lance is positioned outside a bubbling region of the molten metal surface which rising bubbles of the bottom-blowing gas reach, thereby minimizing vibration of the molten metal bath. Preferably, in an orthogonal coordinate system assumed on a stationary (imaginary) molten metal surface as having an origin on the vertical axis of the converter and an x axis parallel to the axis of trunnions supporting the converter, the coordinates (x, y) of the centers of at least four of the hot spots created on the molten metal surface by the oxygen gas jets from the nozzles of the top-blowing multi-nozzle lance fall within the range defined by the inequalities:

$$a/4 \leqq |x| \leqq a/2, \text{ and } b/2 \leqq |y| \leqq b/2+c$$

wherein a is a diameter of the bubbling region in a direction parallel to the trunnion axis, b is a diameter of the bubbling region in a direction perpendicular to the trunnion axis, and c is a radius of a concave defined by the hot spot.

A top-blowing lance for use in the operation of a top-and-bottom blown converter includes a plurality of nozzles at the tip thereof. The nozzles are oriented such that the axis of each of the nozzles is at an angle between 20° and 30° with respect to the axis of the lance.

BRIEF DESCRIPTION OF THE DRAWINGS

The above and other objects, features and advantages of the present invention will be more fully understood from the following description in conjunction with the accompanying drawings, in which.

DETAILED DESCRIPTION OF THE INVENTION

Figure 2:
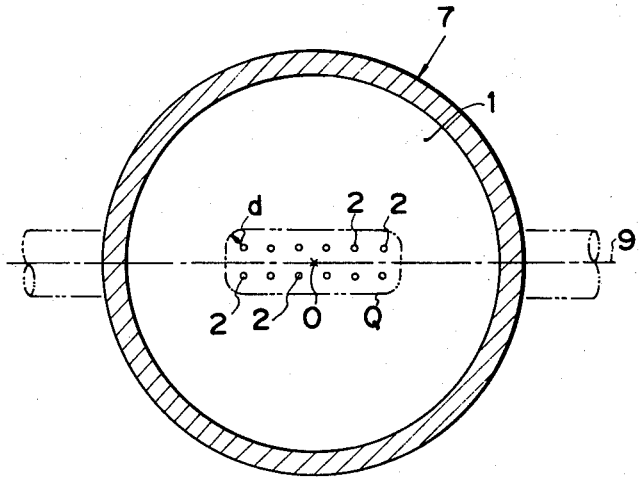
FIG. 2 is a schematic plan view of the bottom of a top-and-bottom blown converter showing the arrangement of tuyeres.
Figure 3:
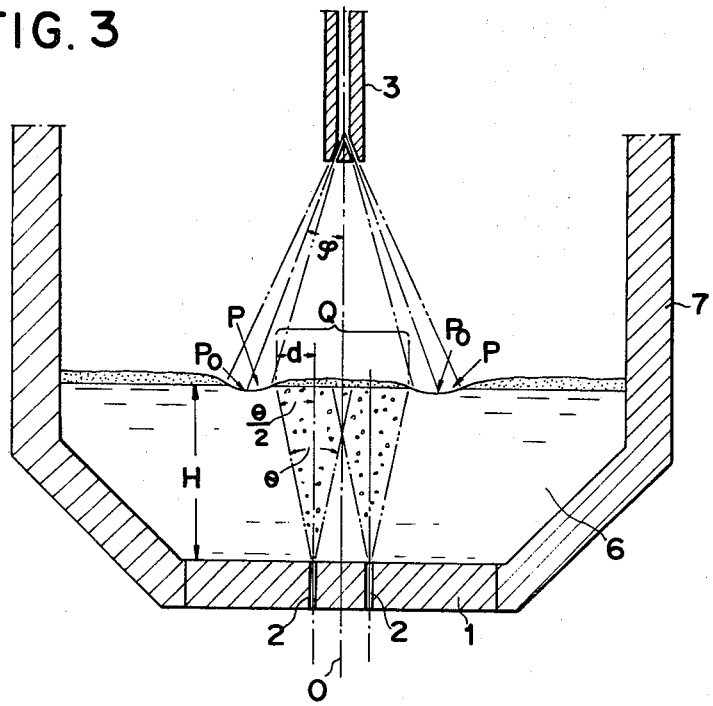
FIG. 3 is a schematic partial illustration of the converter which is being operated by the method of the present invention.

As shown in FIG. 2, it is a common practice in a top-and-bottom blown converter 7 to arrange a plurality of tuyeres 2 at the bottom 1 in one or two rows on or in proximity of a line passing through the axis of the converter and parallel to the axis 9 of trunnions supporting the converter for pivotal motion. In this case, the molten metal bath waves or vibrates mainly in a direction perpendicular to the tuyere aligning line, in a manner similar to water moving alternately in opposite directions in a U-shaped tube. A rotational vibration about the converter axis takes place additionally. We have found that such vibration of the molten metal bath is attributable to a change with time of passage of bubbles resulting from gas jets injected from the bottom blowing tuyeres, and that once the molten metal bath has waved or vibrated, the direction of the bottom-blowing gas jets is also declined toward the vibrating direction to increasingly enhance the vibration. Since it is unnecessary in the top-and-bottom blown converter for the impact energy imparted to the molten metal surface by the oxygen gas jets from the top-blowing lance to assist in agitating the molten metal, the hot spots created on the molten metal surface by the oxygen gas jets from the lance nozzles need not be concentrated at or in proximity of the axis of the converter. Based on the speculation that the impact energy of the top-blowing oxygen gas jets might be used as energy for overcoming the vibration of the molten metal bath, that is, vibration damping or absorbing energy by changing the location of hot spots from the conventional arrangement, we made a model experiment using water under similar conditions as might occur in an actual top-and-bottom blown converter. We found that vibration of the molten metal bath due to the bottom-blowing gas is enhanced when the centers of the hot spots created on the molten metal surface by oxygen gas jets injected from the nozzles of a top-blowing multi-nozzle lance were positioned within the bottom-blowing gas bubbling region, as experienced in the prior art, whereas vibration of the bath was diminished when the centers $P_0$ of the hot spots P were positioned outside the bottom-blowing gas bubbling region Q as shown in FIG. 3, and a remarkable vibration attenuation effect was obtained particularly when the centers of the hot spots were outside, but adjacent the corners of the bubbling region. This novel finding was proved to be correct in actual converter operations.

The above-mentioned water model experiment will be described in detail. The bubbling region which rising bubbles of the bottom-blowing gas reach may be defined as follows. Provided that H is a depth of the molten metal bath 6 and $\theta$ is an angle of dispersion of an oxygen jet from each tuyere 2 as shown in FIG. 3, a bubbling zone of the molten metal surface that bubbles of the oxygen gas from each tuyere reach is horizontally and radially spread from the center vertically aligned with the tuyere over a radius d:

$$d = H \cdot \tan(\theta/2)$$

Then, the gas bubbling region covering all the tuyeres may be given by horizontally expanding an envelope encircling the tuyeres outward over the distance d. For example, an overall bottom-blowing gas bubbling region Q is shown in FIG. 2 as being defined by horizontally expanding an envelope encircling the vertical projections on a stationary molten metal surface of the tuyeres 2 over the distance d. It has also been empirically determined that the angle $\theta$ of dispersion of the bottom-blowing gas jet is approximately 20° under normal conditions.

Figure 5:
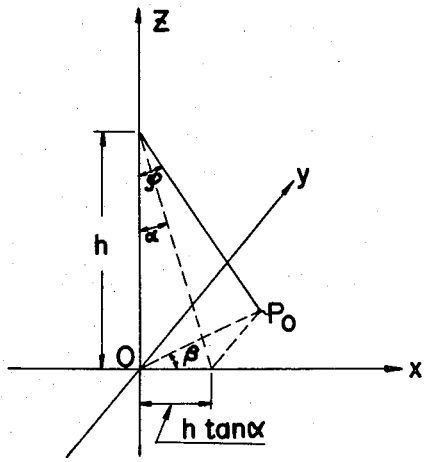
FIG. 5 is a diagram illustrating the inclination angle of a nozzle of the top-blowing lance.
Figure 4:
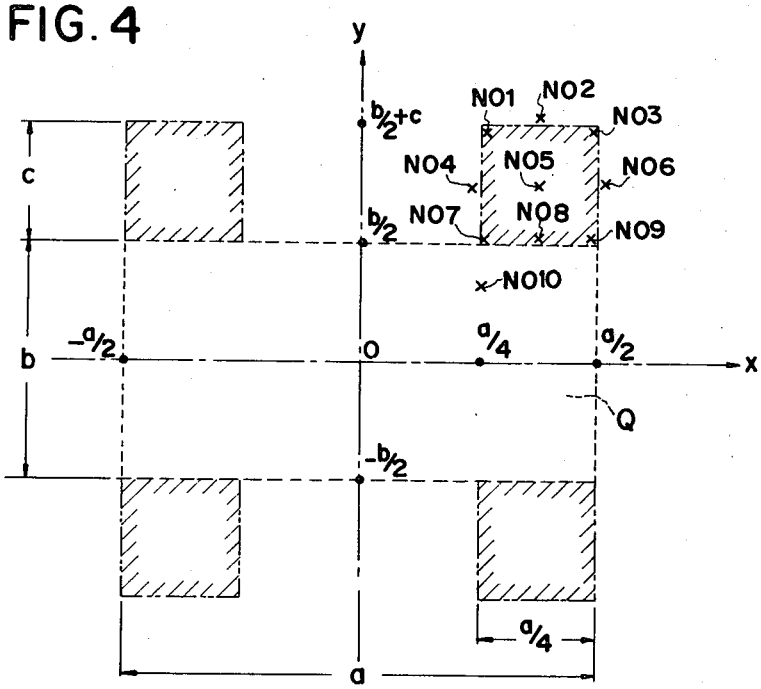
FIG. 4 is a coordinate diagram showing the centers of hot spots relative to the bottom blowing gas bubbling region in a model experiment using water.

In a 1/10 scale water model, that is, a converter model made to a scale of 1/10 of an actual top-and-bottom blown converter and using water instead of molten iron, the magnitude of vibration (or acceleration) of the model housing was measured while the location of hot spots created by oxygen gas jets from the nozzles of a top-blowing four-nozzle lance was changed in relation to the above-defined bottom-blowing gas bubbling region. In this water model experiment, the depth of the bath was 170 mm, and the distance from the stationary bath surface to the opening end of the nozzles of the four-nozzle lance, that is the nozzle height, was 250 mm. A number of four-nozzle lances having different nozzle inclination angles were prepared and the lances were exchanged one by one to change the location of hot spots. Among a number of hot spots with which the magnitude of vibration was determined in this water model experiment, the centers of representative hot spots are plotted at cross (x) signs (Nos. 1–10) in the diagram of FIG. 4. The vibration attenuation factor and the nozzle inclination angles $\alpha$ and $\beta$ for each location are shown in Table 1. In FIG. 4, origin 0 coincides with the axis of the converter, axis x is a line passing the converter axis 0 and parallel to the trunnion axis, axis y is a line passing the converter axis 0 and perpendicular to the trunnion axis, a represents a longer diameter of the bottom-blowing gas bubbling region in a direction parallel to the trunnion axis, and b represents a shorter diameter of the bubbling region in a direction perpendicular to the trunnion axis. A region defined by two sets of broken lines (corresponding to $x = \pm a/2$ and $y = \pm b/2$) in FIG. 4 substantially corresponds to the bottom-blowing gas bubbling region Q. In addition, c represents a radius of a concave created by a jet from each lance nozzle, that is, a hot spot. Although the centers of the hot spots are depicted by cross signs only in the first quadrant for the sake of illustration, of course, similar hot spots appear in the second, third and fourth quadrants symmetrically with respect to x and y axes. In Table 1, $\alpha$ represents an angle obtained by projecting on plane x-z the angle between the axis of each nozzle and the axis of the four nozzle lance, wherein z represents a vertical axis extending from the origin 0 above the plane of the sheet of FIG. 4, and $\beta$ represents an angle obtained by projecting the same nozzle angle on plane x-y. These angles are clearly shown in FIG. 5. Provided that the distance from the stationary bath surface to the opening end of the lance nozzle, that is the lance height, is represented by h, as readily understood from FIG. 5, position $P_0(x, y)$ representative of the center of a hot spot created by a gas jet from a nozzle having projected inclination angles $\alpha$ and $\beta$ may be given by the equations:

$$x = h \cdot \tan \alpha \quad (1)$$

$$\text{TI } y = x \cdot \tan \beta = h \cdot \tan \alpha \cdot \tan \beta \quad (2)$$

It is to be noted that in Table 1, the vibration attenuation factor (%) is obtained by measuring the acceleration in a direction parallel to the trunnion axis at a trunnion support stand and comparing the measured value with the standard value which is measured when the vibration of a molten metal bath is solely caused by the bottom-blowing gas without blowing any gas onto the bath surface through the top-blowing lance.

TABLE 1

| Experiment No. | 1 | 2 | 3 | 4 | 5 | 6 | 7 | 8 | 9 | 10 |
|---|---|---|---|---|---|---|---|---|---|---|
| $\alpha$ (degree) | 6 | 9 | 11 | 5 | 9 | 12 | 6 | 9 | 11 | 6 |
| $\beta$ (degree) | 61 | 53 | 44 | 59 | 45 | 35 | 45 | 34 | 29 | 31 |
| Vibration attenuation factor (%) | 80 | 15 | 85 | 10 | 90 | 10 | 80 | 85 | 85 | −25 |

As apparent from the data of Table 1, vibration is undesirably enhanced in experiment No. 10 where the center of a hot spot is positioned within the bottom-blowing gas bubbling region Q, and vibration is more or less attenuated in experiment Nos. 1–9 where the hot spot center is positioned outside the bubbling region Q. It is also evident that vibration attenuation is remarkable in experiment Nos. 1, 3, 5 and 7–9 where the hot spot center is within a hatched area shown in FIG. 4, for example, defined by inequalities:

$$a/4 \leqq x \leqq a/2, \text{ and } b/2 \leqq y \leqq b/2+c \quad (3)$$

for the first quadrant. This may be extrapolated for all the quadrants, which indicates that the optimum vibration attenuation is achieved when the centers of hot spots are positioned in the areas defined by $$a/4 \leqq |x| \leqq a/2, \text{ and } b/2 \leqq |y| \leqq b/2+c \quad (4)$$

From equations (1) and (2), $\alpha$ and $\beta$ may be given by the following equations:

$$\alpha = \tan^{-1}\frac{x}{h} \quad (5)$$

$$\beta = \tan^{-1}\frac{y}{h \cdot \tan\alpha} \quad (6)$$

Accordingly, the optimum vibration attenuation is achieved by setting the projected inclination angles $\alpha$ and $\beta$ of the lance nozzle to meet equations (5) and (6) in accordance with the lance height h as long as (x, y) satisfies equation (4).

On the basis of the data obtained in the water model experiment, another experiment was made in an actual converter. A top-and-bottom blown converter used was a modification of a 250-ton LD converter. Five four-nozzle lances having different nozzle inclination angles were prepared. A blowing experiment was done for each lance under the conditions that the lance height h was 2500 mm, the flow rate of bottom-blowing gas was 300 $Nm^3$/min., the flow rate of oxygen through the top-blowing lance was 450 $Nm^3$/min., and the average depth of a molten iron bath was 1700 mm. The magnitude of vibration or acceleration at a trunnion support stand was measured in a direction parallel to the trunnion axis. The positions of the centers of hot spots created by oxygen gas jets from nozzles of various lances are depicted at cross (x) signs referred to as Nos. 11–15 in FIG. 6. The angle of inclination of a lance nozzle in a direction of x axis. The projected inclination angles $\alpha$ and $\beta$ of a lance nozzle in directions of x and y axes and the vibration attenuation factor (%) corresponding to each of the hot spots are shown in Table 2. The meanings of x and y axes, a, b, c and Q in FIG. 6 are as defined in FIG. 4, and the vibration attenuation factor in Table 2 is as defined in Table 1.

TABLE 2

| Experiment No. | 11 | 12 | 13 | 14 | 15 |
|---|---|---|---|---|---|
| $\alpha$ (degree) | 9 | 11 | 9 | 9 | 6 |
| $\beta$ (degree) | 53 | 44 | 45 | 34 | 31 |
| Vibration attenuation factor (%) | 30 | 75 | 85 | 80 | −15 |

Figure 6:
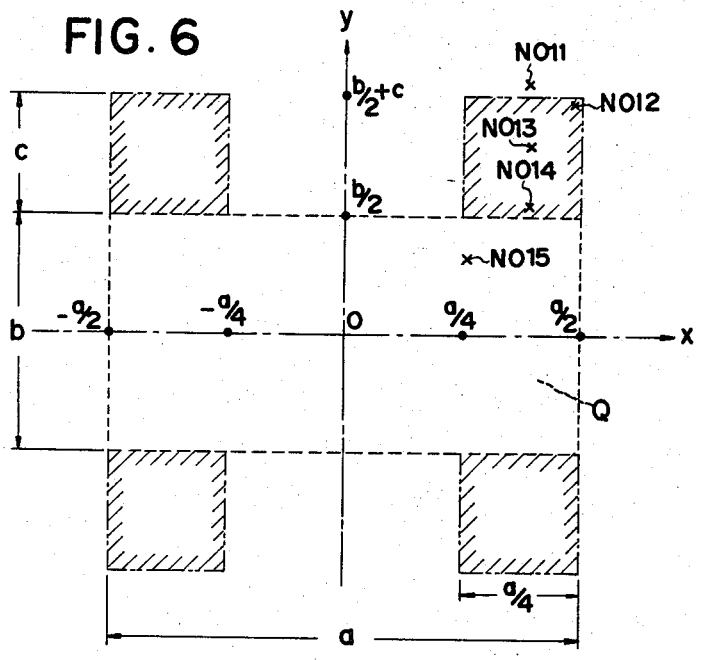
FIG. 6 is a coordinate diagram showing the centers of hot spots relative to the bottom-blowing gas bubbling region in an experiment using an actual converter.

As seen from FIG. 6 and Table 2, it was demonstrated in the actual converter that vibration of a molten iron bath is enhanced when the center of a hot spot is within the bottom-blowing gas bubbling region Q (experiment No. 15), vibration is attenuated when the hot spot center is outside the bubbling region Q (experiment Nos. 11–14), and the vibration attenuation effect is remarkable when the hot spot center is within a hatched zone in FIG. 6, that is, the hot spot center has a coordinate (x, y) satisfying the above-mentioned inequalities (4) (experiment Nos. 12–14).

Figure 1:
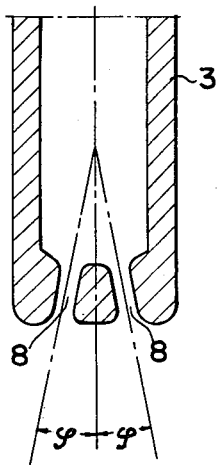
FIG. 1 is a schematic axial cross section of a top-blowing multi-nozzle lance.

As readily understood from equations (1) and (2), the hot spot center represented by a coordinate (x, y) may vary with the lance height h. This means that when a lance having nozzles with a given inclination angle is set at different lance heights, the hot spot centers also appear at different positions. In an actual operation, the lance heigh h is previously set to a certain value, and the inclination angle of the lance nozzle is then determined in relation to the preset lance height such that the resultant hot spot centers may be outside the bottom-blowing gas bubbling region, and more preferably, the resultant hot spot centers may have a coordinate (x, y) satisfying the above-mentioned inequalities (4). A lance having nozzles with such a predetermined inclination angle must be used. However, even when the operation has started with the lance height h of a preset value, the lance height h is often changed in response to varying conditions in the progress of an actual converter operation. If the lance height h is lowered during the operation, for example, the hot spot centers are inwardly moved to within a bottom-blowing gas bubbling region to undesirably enhance vibration. Furthermore, it is cumbersome in the actual operation to exchange the lance in accordance with the lance height h and the dimensions of the bottom-blowing gas bubbling region before the operation of a new batch is started. For these reasons, the preferred top-blowing multi-nozzle lances for use in the practice of the method of the present invention are those lances having oriented nozzles in which the angle included between the axes of each nozzle and the lance, that is, the nozzle inclination angle (angle $\phi$ as depicted in FIG. 1) is from 20° to 30°, which value is remarkably larger than the previously used nozzle inclination angle of 8°–10°. With a nozzle inclination angle of at least 20°, the resultant hot spot centers will possibly appear outside the bottom-blowing gas bubbling region under normal operating conditions in a commonly used top-and-bottom blown converter having a capacity of about 80 tons or more. In the case of the top-and-bottom blown converter, the top-blowing oxygen gas jet is not expected to effect substantial decarbonization unlike the top-blown converter, and the lance height is often set at a higher value than in the top-blown converter, thereby providing a soft blow. Generally, the lance height is about 1500 mm or more. With a lance height of about 1500 mm, if the nozzle inclination angle $\phi$ is at least 20°, the resultant hot spot centers will appear outside the bottom-blowing gas bubbling region to suppress vibration of a molten metal bath. In this manner, the bath vibration will be effectively suppressed even when the lance height h and other conditions are altered during the actual operation. On the other hand, if the nozzle inclination angle $\phi$ exceeds 30°, there is the likelihood that oxygen gas be directly blown onto a refractory brick on the converter barrel during vertical movement of the top-blowing lance, causing wear or failure of the refractory brick. For the above reasons, a multi-nozzle lance having a nozzle inclination angle between 20° and 30° is preferably used in the actual operation of a top-and-bottom blown converter.

Figure 7:
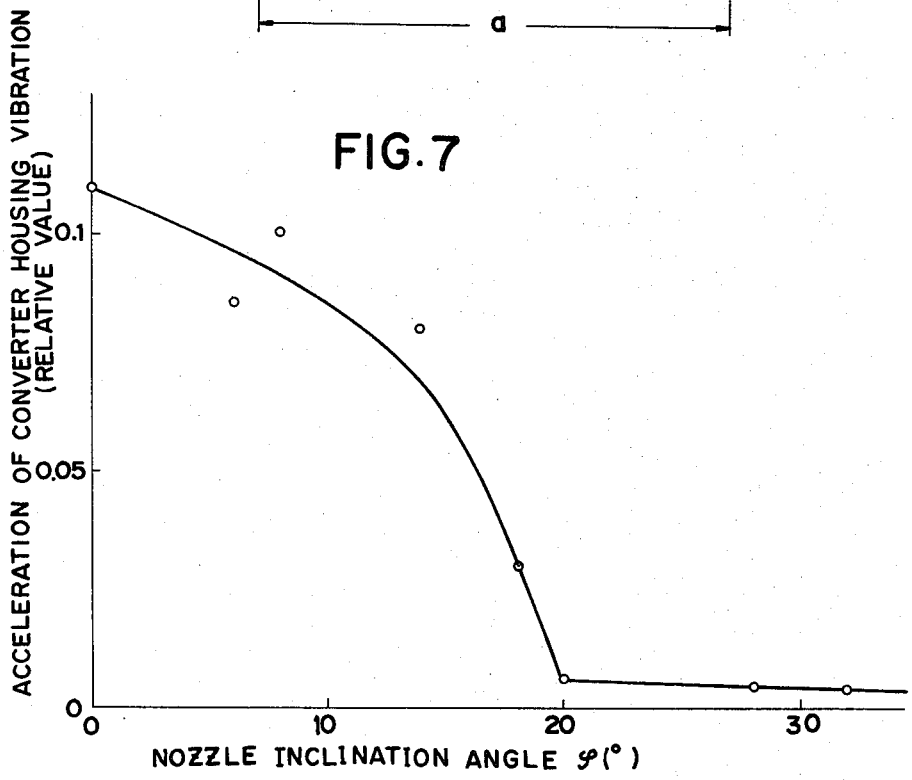
FIG. 7 is a graph showing the relationship of the nozzle inclination angle $\phi$ to the acceleration of converter housing vibration.

A further experiment was made to determine the relationship of the nozzle inclination angle $\phi$ to the vibration of a converter housing when the lance height was set to 1500–1800 mm. The results are shown in FIG. 7. In a top-and-bottom blown converter constructed by modifying a 250-ton top-blown converter, a number of blowing operations were carried out using a corresponding number of top-blowing lances having different nozzle inclination angles. The acceleration was measured at a trunnion support stand in a direction parallel to the trunnion axis. The oxygen flow rate through the top-blowing lance was 400–600 $Nm^3$/min., the oxygen flow rate through the bottom-blowing tuyeres was 350–250 $Nm^3$/min., and the top-blowing lance used was a four-nozzle lance having a throat diameter of 38–40 mm. As seen from FIG. 7, when the lance height is 1500–1800 mm, the vibration of the converter housing is reduced to a substantially negligible level by setting the nozzle inclination angle $\phi$ to 20° or more.

Figure 8:
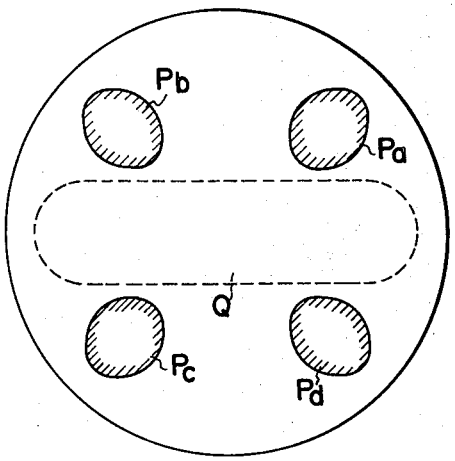
FIG. 8 is a schematic view showing the location of hot spots created in an example where the nozzle inclination angle is set to 28°.
Figure 9:
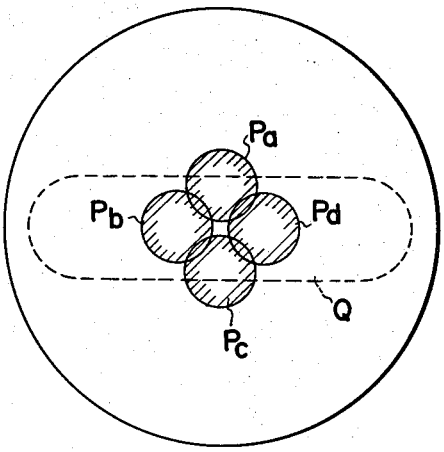
FIG. 9 is a schematic view showing the location of hot spots created in a comparative example where the nozzle inclination angle is set to 9.1°.
Figure 10:
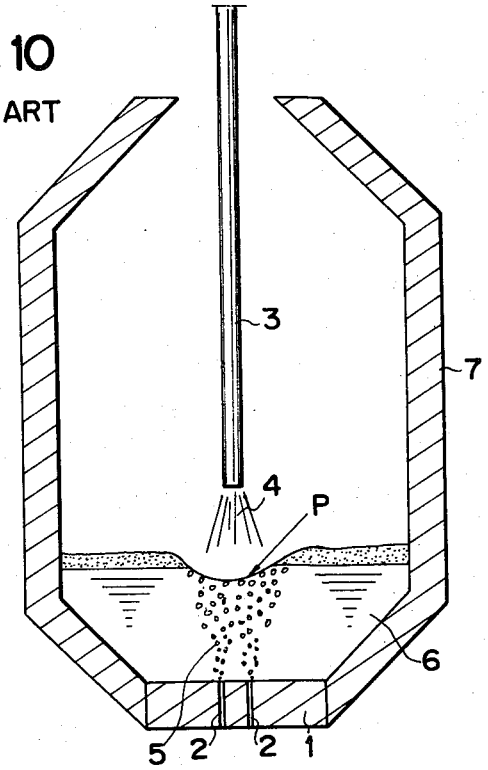
FIG. 10 PRIOR ART
FIG. 10 is a schematic cross section of a known top-and-bottom blown converter which is constructed by modifying a conventional top-blown converter.

FIGS. 8 and 9 show the confines on the molten metal surface at which oxygen gas jets from the nozzles of the top-blowing lance impinge to create hot spots, in an example wherein the nozzle inclination angle is in the range between 20° and 30° and a comparative example wherein the nozzle inclination angle is less than 20°, respectively. In the case of FIG. 8, a blowing operation was carried out in a top-and-bottom blown converter equipped with bottom-blowing tuyeres arranged on a line parallel to the trunnion axis and a four-nozzle lance having a throat diameter of 42 mm and a nozzle inclination angle of 28°. The top-blowing oxygen gas flow rate was 560 $Nm^3$/min. and the bottom-blowing gas flow rate was 370 $Nm^3$/min. In this case, hot spots Pa–Pd were definitely outside the bottom-blowing gas bubbling region Q encircled by a broken line in FIG. 8. The acceleration measured at a trunnion support stand in a direction parallel to the trunnion axis was as small as 0.02 G (wherein G is the acceleration of gravity). In the case of FIG. 9, a blowing operation was carried out in the same manner as described for the example of FIG. 8 except that the nozzle inclination angle was 9.1°. In this comparative example, hot spots pa–Pd largely overlap the bottom-blowing gas bubbling region Q. The acceleration measured as above was 0.08 G.

As seen from the foregoing, the method of the present invention for operating a top-and-bottom blown converter by blowing the top-blowing oxygen gas such that the center of a hot spot created by an oxygen gas jet from each of the nozzles of a top-blowing multi-nozzle lance is positioned outside a bubbling region of the molten metal surface which rising bubbles of the bottom-blowing gas reach, has the many advantages that vibration of the molten metal bath is significantly reduced as compared with the prior art, to thereby minimize vibration of the converter housing, and consequently, even a top-and-bottom blown converter of the type which is constructed by modifying an existing top-blown converter is unlikely to undergo fatigue failure at its housing support, that the blowing operation can be carried out in a stable manner, and that possible danger to the operators is minimized. Furthermore, by using a top-blowing lance having nozzles with an inclination angle between 20° and 30° in the operation of a top-and-bottom blown converter, the centers of hot spots created therewith can be positioned outside the bottom-blowing gas bubbling region, thereby ensuring the stable and effective operation of the converter.

It should be understood that the application of the present invention is not limited to the above-described type of top-and-bottom blown converter which is constructed by modifying a top-blown converter, and the present invention is also applicable to those converters constructed by adding a top-blowing lance to a bottom-blown converter.

We claim:

1. A method of operating a top-and-bottom converter of the type including a converter housing containing a molten metal bath, a plurality of tuyeres arranged in the bottom of said housing for blowing a gas into said molten metal, and a multi-nozzle lance inserted through a top opening of said housing for blowing plural jets oxygen gas onto a surface of said molten metal, said method comprising:

injecting said gas through said tuyeres such that bubbles of said gas rise upwardly through said molten metal and reach said surface within a bubbling region thereof; and directing said jets of oxygen gas against said surface such that the center of a hot spot created on said surface by each said jet is positioned outside said bubbling region.

2. A method as claimed in claim 1, further comprising defining said bubbling region by horizontally expanding an envelope encircling the vertical projections on a stationary molten metal surface of said tuyeres over a distance H·tan ($\theta/2$), wherein:

$\theta$ is an angle of dispersion of said gas injected from each said tuyere into said molten metal bath; and H is the depth of said molten metal bath between said surface and the converter bottom.

3. A method as claimed in claim 1, further comprising arranging said tuyeres in at least one row extending parallel to the axis of trunnions supporting said converter.

4. A method as claimed in claim 1, comprising directing said jets of oxygen gas such that in an orthogonal coordinate system assumed on a stationary molten metal surface as having an origin on the vertical axis of said converter and an x axis parallel to the axis of trunnions supporting said converter, the coordinates (x, y) of the center of each of at least four of said hot spots created on said molten metal surface by said jets of oxygen gas from said nozzles of said lance fall within the range defined by the inequalities:

$$a/4 \leqq |x| \leqq a/2, \text{ and } b/2 \leqq |y| \leqq b/2+c$$

wherein a is a diameter of said bubbling region in a direction parallel to said trunnion axis, b is a diameter of said bubbling region in a direction perpendicular to said trunnion axis, and c is a radius of a concave defined by each said hot spot.

5. A method as claimed in claim 1, further comprising providing said nozzles of said lance with respective axes each extending at an angle of from 20° to 30° with respect to the axis of said lance.

* * * * *